US008881634B1

(12) United States Patent
Worrell, Jr. et al.

(10) Patent No.: US 8,881,634 B1
(45) Date of Patent: Nov. 11, 2014

(54) MUZZLE LOADER POWDER INCREMENT USING CELLULOID COMBUSTIBLE CONTAINER

(71) Applicant: Alliant Techsystems Inc., Minneapolis, MN (US)

(72) Inventors: William J. Worrell, Jr., Draper, VA (US); Benjamin R. Vaughan, Blacksburg, VA (US); Sandra L. Case, Blacksburg, VA (US); Ming-Wan Young, Basking Ridge, NJ (US); Costas G. Gogos, Wyckoff, NJ (US); Niloufar Faridi, Melville, NY (US); Linjie Zhu, Livingston, NJ (US); Peter Bonnett, Succasunna, NJ (US); Howard Shimm, Budd Lake, NJ (US); Elbert Caravaca, Budd Lake, NJ (US); Joseph Palk, Jr., Ledgewood, NJ (US); Dale Conti, Flanders, NJ (US); Mohamed Elalem, East Orange, NJ (US); Fei Shen, North Arlington, NJ (US)

(73) Assignee: Alliant Techsystems Inc., Minneapolis, MN (US)

( * ) Notice: Subject to any disclaimer, the term of this patent is extended or adjusted under 35 U.S.C. 154(b) by 0 days.

(21) Appl. No.: 13/959,138

(22) Filed: Aug. 5, 2013

Related U.S. Application Data

(63) Continuation of application No. 13/160,171, filed on Jun. 14, 2011, now abandoned, which is a continuation-in-part of application No. 12/977,374, filed on Dec. 23, 2010, now Pat. No. 8,597,444, which is a continuation-in-part of application No. 12/483,420, filed on Jun. 12, 2009, now Pat. No. 8,617,328.

(60) Provisional application No. 61/061,249, filed on Jun. 13, 2008.

(51) Int. Cl.

| | |
|---|---|
| ***F42B 33/02*** | (2006.01) |
| ***F42B 5/192*** | (2006.01) |
| ***F42B 5/188*** | (2006.01) |
| ***F42B 5/18*** | (2006.01) |

(52) U.S. Cl.
CPC . *F42B 5/18* (2013.01); *F42B 5/192* (2013.01); *F42B 5/188* (2013.01)
USPC ..... 86/10

(58) Field of Classification Search
CPC ..... F42B 30/12; F42B 5/38; F42B 5/188
USPC ..... 86/10, 19.8; 102/431, 465–466
See application file for complete search history.

(56) References Cited

U.S. PATENT DOCUMENTS

| | | | |
|---|---|---|---|
| 35,699 | A | 6/1862 | Mayberry |
| 1,528,101 | A | 3/1925 | Davison et al. |

(Continued)

FOREIGN PATENT DOCUMENTS

| | | |
|---|---|---|
| EP | 0463904 | 1/1992 |
| EP | 0922390 | 6/1999 |

OTHER PUBLICATIONS

Audra Calloway, "The shape of things to come," Internet citation, Jun. 3, 2011. http://www.pica.army.mil/eVoice/article.aspx?ArticleID=1841.

(Continued)

*Primary Examiner* — Stephen M Johnson
*Assistant Examiner* — Benjamin Gomberg
(74) *Attorney, Agent, or Firm* — Vidas, Arrett & Steinkraus

(57) ABSTRACT

An encapsulated propellant charge comprised a sealed combustible container comprised of a consumable material and having a substantially cylindrical shape. The sealed combustible container comprises a top wall, a bottom wall, and a side wall therebetween. The top wall, the bottom wall and the side wall define a chamber; which contains a propellant composition.

12 Claims, 3 Drawing Sheets

(56) References Cited

U.S. PATENT DOCUMENTS

| | | | | |
|---|---|---|---|---|
| 2,424,934 | A | 7/1947 | Kasper | |
| 2,991,168 | A | 7/1961 | Nadel | |
| 3,098,444 | A | 7/1963 | Walkey et al. | |
| 3,164,092 | A | 1/1965 | Reed et al. | |
| 3,212,440 | A | 10/1965 | Quinlan et al. | |
| 3,311,057 | A | 3/1967 | Quinlan et al. | |
| 3,336,871 | A | 8/1967 | Quinlan | |
| 3,348,445 | A | 10/1967 | Nadel | |
| 3,396,658 | A | 8/1968 | Scanlon, Jr. et al. | |
| 3,482,516 | A | 12/1969 | Farmer et al. | |
| 3,598,052 | A | 8/1971 | Schwartz et al. | |
| 3,658,008 | A | 4/1972 | Larson | |
| 3,732,819 | A | 5/1973 | Quinlan et al. | |
| 3,901,153 | A | 8/1975 | Brabets et al. | |
| 3,987,731 | A | 10/1976 | Brzuskiewicz | |
| 4,207,698 | A | 6/1980 | Burson | |
| 4,356,769 | A | 11/1982 | Galluzzi | |
| 4,572,076 | A | 2/1986 | Politzer et al. | |
| 4,709,636 | A | 12/1987 | Mueller et al. | |
| 4,759,824 | A | 7/1988 | Muller et al. | |
| 4,759,885 | A | 7/1988 | Kurtz | |
| 4,949,640 | A | 8/1990 | Reinelt | |
| 5,323,707 | A | 6/1994 | Norton et al. | |
| 5,449,423 | A * | 9/1995 | Cioffe | 149/19.1 |
| 5,557,151 | A | 9/1996 | Epstein et al. | |
| 5,633,476 | A | 5/1997 | Cioffe | |
| 5,726,378 | A | 3/1998 | Barrett | |
| 6,012,394 | A | 1/2000 | Dion et al. | |
| 6,170,399 | B1 * | 1/2001 | Nielson et al. | 102/336 |
| 6,334,394 | B1 | 1/2002 | Zimmermann et al. | |
| 6,405,654 | B1 | 6/2002 | Smith | |
| 6,688,232 | B2 | 2/2004 | Griesbach et al. | |
| 6,877,415 | B2 * | 4/2005 | Griesbach et al. | 89/34 |
| 7,059,074 | B1 | 6/2006 | Calvete Zumalde | |
| 7,137,218 | B1 | 11/2006 | Adkins, Jr. | |
| 7,726,245 | B2 | 6/2010 | Quesenberry et al. | |
| 2004/0144457 | A1 | 7/2004 | Barrett et al. | |
| 2006/0011086 | A1 | 1/2006 | Rose et al. | |
| 2006/0169164 | A1 * | 8/2006 | Brus et al. | 102/431 |
| 2006/0230971 | A1 | 10/2006 | Harrison | |
| 2009/0266263 | A1 | 10/2009 | Quesenberry et al. | |
| 2010/0275487 | A1 | 11/2010 | Quesenberry et al. | |
| 2011/0174185 | A1 | 7/2011 | Epstein et al. | |

OTHER PUBLICATIONS

"Identificaiton of Ascorbic Acid and Its Degradation Products in Black Powder Substitutes" by John V. Goodpaster, and Raymond Keto. J. Forensic Sci. May 2004, vol. 49, No. 3, 2004, pp. 523-528.

Senator Frank R. Lautenberg website, Advanced Foamed Celluloid Technology, May 6, 2010, p. 18.

Senator Frank R. Lautenberg website, Advanced Foamed Celluloid Technology, Jan. 6, 2011, p. 19.

* cited by examiner

MUZZLE LOADER POWDER INCREMENT USING CELLULOID COMBUSTIBLE CONTAINER

CROSS-REFERENCE TO RELATED APPLICATIONS

This application is a continuation-in-part of U.S. application Ser. No. 13/160,171, filed Jun. 14, 2011. This application is also a continuation-in-part of U.S. application Ser. No. 12/977,374, filed Dec. 23, 2010, which is a continuation-in-part of U.S. application Ser. No. 12/483,420, filed Jun. 12, 2009, which claims priority from provisional U.S. application No. 61/061,249, filed Jun. 13, 2008.

STATEMENT REGARDING FEDERALLY SPONSORED RESEARCH

Not applicable

BACKGROUND OF THE INVENTION

The present invention generally relates to ammunition for muzzle-loader firearms, and more particularly to propellant charges having a consumable cartridge case. Some embodiments are directed to the manufacture and methods of use of such devices.

In muzzle-loader firearms, multiple ammunition components are loaded from the open end of the barrel. These multiple components include at least a propellant charge and projectile. The propellant charges comprise an amount of black powder, black powder substitutes, and smokeless gunpowder. The projectile typically comprises a bullet and a sabot. In some instances, the projectile and the propellant charge are inserted into the barrel as a unitary structure. Alternatively, the propellant charge is loaded separately from the projectile. In such instances, the propellant charge is loaded first into the barrel, followed by the sabot and the bullet.

The propellant charges are loaded into the barrel either in a granular form or in a compacted or consolidated pellet. The pellet allows for a simple, accurate and precise measurement of the propellant. U.S. Pat. Nos. 5,726,378 and 6,688,232, incorporated by reference in their entireties herein, describe exemplary pellets. In either the granular form or the pellet, the propellant is susceptible to moisture absorption and other environmental effects that can result in undesirable ballistic variation and corrosion of the firearm barrel and chamber.

The art referred to and/or described above is not intended to constitute an admission that any patent, publication or other information referred to herein is "prior art" with respect to this invention. In addition, this section should not be construed to mean that a search has been made or that no other pertinent information as defined in 37 C.F.R. §1.56(a) exists. All U.S. patents and applications and all other published documents mentioned anywhere in this application are incorporated herein by reference in their entirety.

BRIEF SUMMARY OF THE INVENTION

The present invention prevents exposure of the propellant to moisture and other environmental effects with enhanced ignition and ballistic reproducibility capabilities. A propellant charge comprises a sealed combustible container comprised of a consumable material and having a substantially cylindrically shape. The sealed combustible container comprises a top wall, a bottom wall, and a side wall therebetween.

The top wall, the bottom wall and the side wall define a chamber; wherein the chamber contains a propellant composition. In at least one embodiment, the consumable material is a foamed celluloid. In at least one embodiment, the propellant composition is selected from the group consisting of: smokeless propellant, single base nitrocellulose, nitrocellulose propellant, black powder propellant, pyrotechnic propellant, non-pyrotechnic propellant, and any combination thereof.

In at least one embodiment, an ammunition round for a muzzle-loader is provided. The ammunition round comprises a bullet and at least one propellant charge having an outer wall constructed from a consumable material. The outer wall defines a chamber that is at least partially filled with at least one propellant composition having a charge weight.

BRIEF DESCRIPTION OF THE SEVERAL VIEWS OF THE DRAWING(S)

DETAILED DESCRIPTION OF THE INVENTION

This invention contemplates a number of embodiments where any one, any combination of some, or all of the embodiments can be incorporated into ammunition. In addition, this invention contemplates a number of embodiments where any one, any combination of some, or all of the embodiments can be incorporated into a method of using such ammunition.

Figure 1:
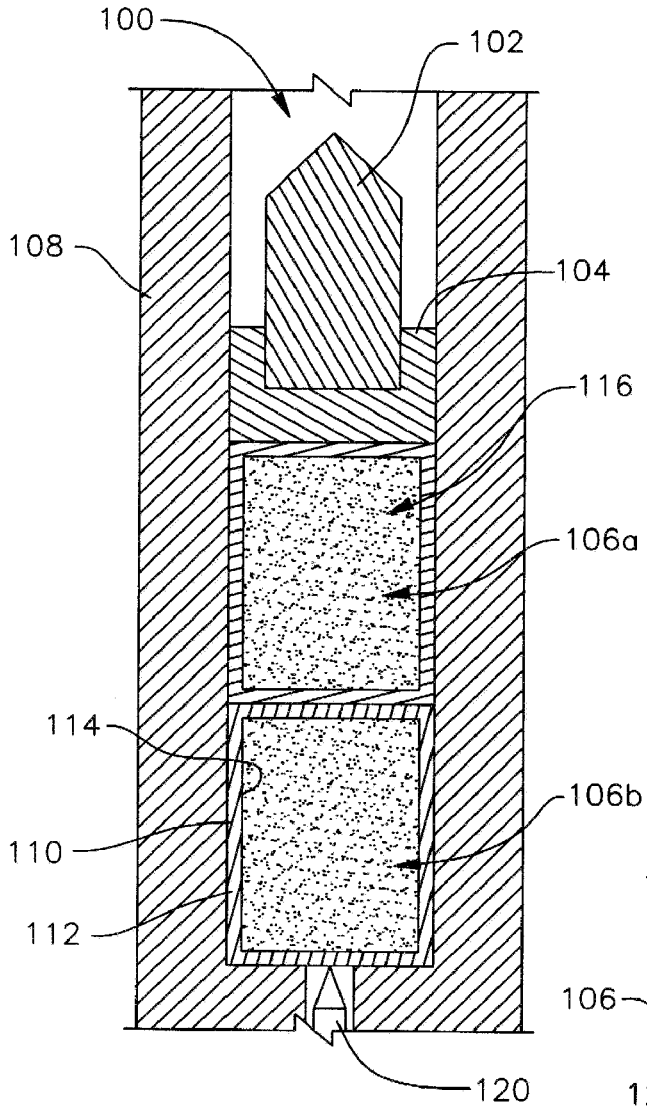
FIG. 1 is a cross-sectional view of the muzzle of a muzzle-loader firearm with ammunition using the encapsulated propellant charge of the present invention.

Referring now to FIG. 1, there is shown an embodiment of the invention featuring a muzzle-loaded ammunition round 100 having a bullet 102, a sabot 104, and at least one encapsulated propellant charge 106 loaded into a barrel 108 of a firearm. The bullet 102 is held in place at one end by sabot 104, which in turn is engaged with an encapsulated propellant charge 106. For purposes of this application, the definition of the term "bullet" is a projectile fired by a firearm intended and designed for the purpose of striking a target. Bullets include saboted bullets, full bore non-saboted bullets, and shotgun shot. Bullets do not include sabot, wads, propellant, cartridge cases, compressed gas, or any other material ejected from the barrel of a fired firearm other than the projectile missile intended and designed to strike a target.

Depending on the propellant requirements for a given muzzle-loaded firearm, the ammunition round can include one or more than one encapsulated propellant charge 106. In the embodiment shown in FIG. 1, the ammunition round 100 includes two encapsulated propellant charges 106*a* and 106*b*. As shown in FIG. 1, each propellant charge 106 has a capsule 110 having a wall 112 that defines a chamber 114 containing a propellant 116. In at least one embodiment, the capsule 110 is cylindrical. In at least one embodiment, the capsule 110 has a rigid construction. In at least one embodiment, the wall 112 of capsule 110 is formed from a consumable material having sufficient energy or burning rate for muzzle loader applications. In at least one embodiment, the consumable material is a foamed celluloid. In at least one embodiment, the consumable material is a felted nitrocellulose. In some embodiments, the consumable material is selected from the group consisting of molded energetic thermoplastic elastomers and non-energetic thermoplastics filed with an energetic solid, such as nitramines and other energetic solids. In at least one embodiment, the consumable material is different than the propellant 116. In at least one embodiment, the consumable material is water resistant.

The propellant 116 is selected from the group consisting of smokeless propellant, single base nitrocellulose, nitrocellulose propellant, black powder propellant, pyrotechnic propellant, non-pyrotechnic propellant, and any combination thereof. In at least one embodiment, the chamber 114 is substantially filled with the propellant 116.

In at least one embodiment, the ammunition round 100 is constructed and arranged with its rear portion positioned facing a breech block part of the muzzle loading firearm when loaded into a firearm. In some embodiments (such as the embodiment shown in FIG. 1), when loaded into the firearm, at least one encapsulated propellant charge 106 is engaged with the sabot 104 and at least one encapsulated propellant charge 106 is engaged with a portion of the breech block of the firearm. As shown in FIG. 1, when loaded into the firearm, the first encapsulated propellant charge 106*a* is engaged with the sabot 104 and the second encapsulated propellant charge 106*b* is engaged with the first encapsulated propellant charge 106*a*.

In at least one embodiment, the ammunition round is constructed and arranged to be used in combination with a primer or igniter separately positioned within a firearm barrel. When the firearm is triggered, a hammer strikes the primer material which ignites the primer material, resulting in an expulsion of a high temperature energetic jet of combustion products that penetrates the end of the capsule to ignite the encapsulated propellant charge. In other embodiments of the invention, the breech block penetrates an end of the capsule 110 of the encapsulated propellant charge 106 with a probe 120 or bayonet having a sharp point that forms a hole which allows hot materials from the ignited primer to enter the chamber 114 and ignite the propellant 116. The probe 120 can be tubular with a conical tip, can be conical, can be serrated, or can be any combination thereof, or can be of any shape known in the art. The ignition of the first encapsulated propellant charge 106*a* will ignite the second encapsulated propellant charge 106*b*. Ignition of the encapsulated propellant charges 106 provides the energy that propels the bullet 102 at a target. The capsule 110, which in at least one embodiment comprises a consumable material, is entirely consumed following ignition such that no portion of the capsule 110 remains.

Figure 2:
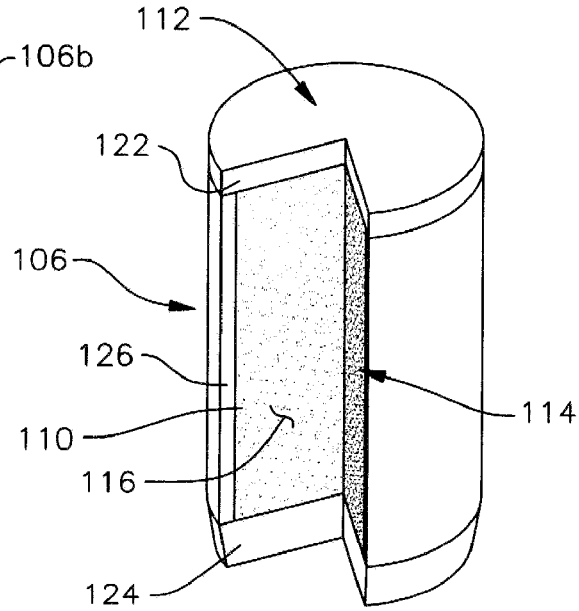
FIG. 2 is a cross-sectional view of the encapsulated propellant charge shown in FIG. 1.

FIG. 2 shows a cross-section of the encapsulated propellant charge 106 with capsule 110 having wall 112 that defines chamber 114. The wall 112 comprises a top wall 122, a bottom wall 124, and a side wall 126 that define the chamber 114. The chamber 114 contains propellant 116. In at least one embodiment, the chamber 114 contains a measured amount of propellant, sometimes referred to as a propellant charge with a charge weight. In an exemplary embodiment, where the propellant charge 106 is used in a .50-caliber muzzle-loader firearm, the chamber contains propellant with a charge weight between about 30 and 100 grains, preferably between about 30 and 50 grains. In other embodiments, the chamber 114 contains an appropriate amount of propellant depending on the caliber of the weapon and other factors. In at least one embodiment, the chamber 114 is substantially filled with propellant 116. In at least one embodiment, the chamber 114 is partially filled with propellant 116. The encapsulated propellant charge 106 is therefore provided in an easy to load and handle form, with in some embodiments a known amount of propellant, while protecting the propellant from moisture absorption and being a fully consumable charge.

In at least one embodiment, the capsule 110 has an axial length L that is greater than its diameter D. In at least one embodiment, the axial length L is twice the diameter D. In at least one embodiment, the axial length is at least three times the diameter D. In some embodiments, the wall thickness is dependent upon the caliber of the firearm being used. In some embodiments, the side wall 126 is thin-walled. In at least one embodiment, the thin-walled side wall 126 has a thickness of less than 0.05 inches (1.27 mm). In at least one embodiment, the side wall 126 has a thickness of between about 0.01 inches (0.254 mm) and 0.03 inches (0.762 mm). In at least one embodiment, the top wall 122 has a thickness of less than 0.05 inches (1.27 mm). In at least one embodiment, the top wall 122 has a thickness of between about 0.01 inches (0.254 mm) and 0.03 inches (0.762 mm). In at least one embodiment, the bottom wall 124 has a thickness of less than 0.05 inches (1.27 mm). In at least one embodiment, the bottom wall 124 has a thickness of between about 0.01 inches (0.254 mm) and 0.03 inches (0.762 mm).

In at least one embodiment, the diameter of the capsule is constant along the length of the capsule. In other embodiments, the diameter of the capsule tapers from a first end to a second end of the capsule. In one embodiment, the bottom wall 124 has an outer diameter that is tapered, as shown in FIG. 2. In other embodiments, the bottom wall 124 has a constant diameter.

Figure 3:
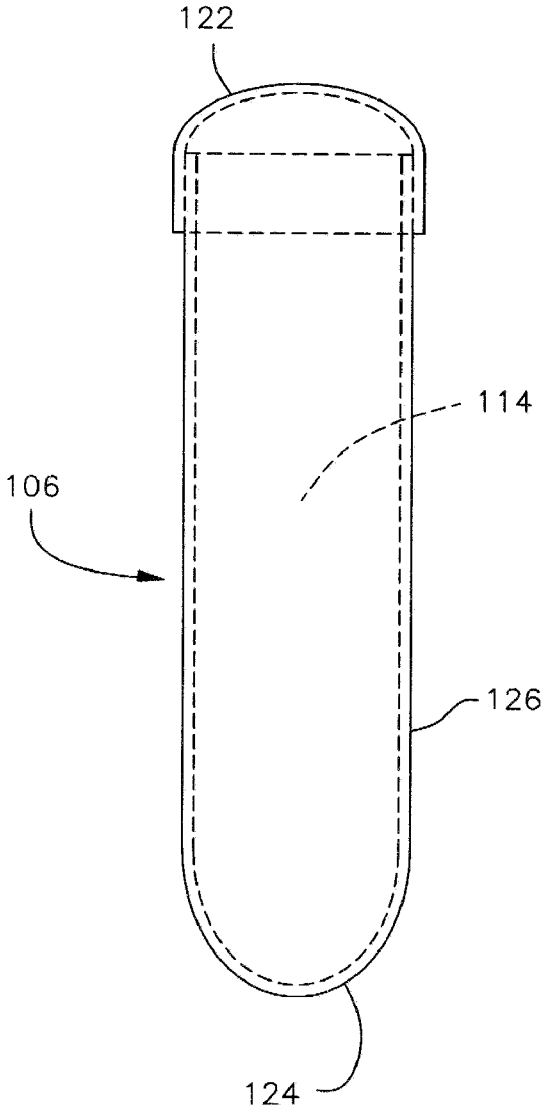
FIG. 3 shows an embodiment of the encapsulated propellant charge.
Figure 4:
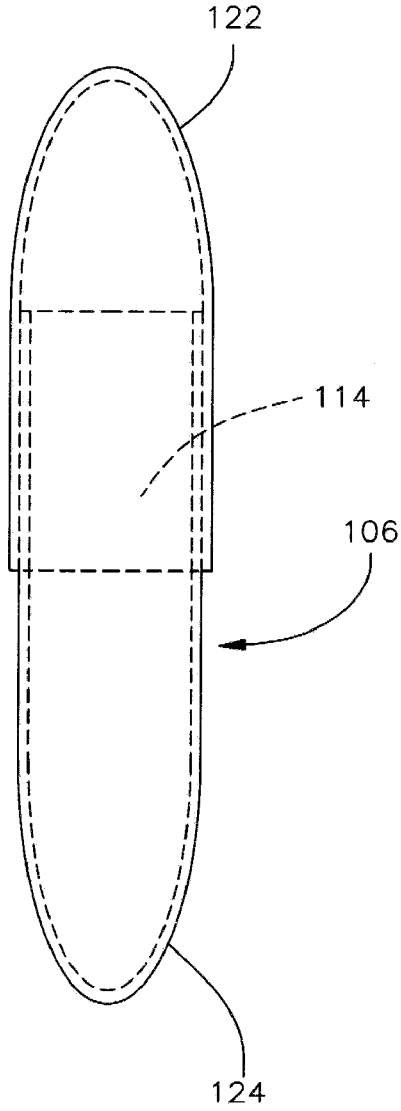
FIG. 4 shows an embodiment of the encapsulated propellant charge.

In at least one embodiment, the capsule has flat ends formed by the top wall and the bottom wall. In other embodiments, the capsule can have an arcuate surface at one end of the capsule. In another embodiment, the capsule can have an arcuate surface at each end of the capsule. FIGS. 3 & 4 show exemplary embodiments with arcuate surfaces forming either or both of the top wall 122 and the bottom wall 124. The embodiments shown in FIGS. 3 & 4 also have a two part construction, where a cap 129 forms at least one of either the top wall 122 or the bottom wall 124.

Figure 5A:
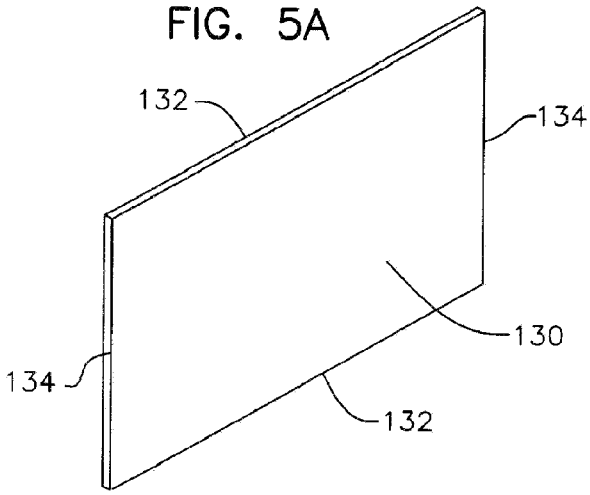
FIGS. 5A-5F show an embodiment of the manufacturing process of the propellant charge.

To manufacture the encapsulated propellant charge 106, in one embodiment, the capsule 110 is made using a thermoforming process. In at least one embodiment shown in FIG. 5A, a sheet 130 of the consumable material having sides 132 and ends 134 is heated to a predetermined softening temperature. In at least one embodiment, the consumable material is a foamed celluloid material. This material forms a hard, plastic capsule when thermoformed.

Figure 5B:
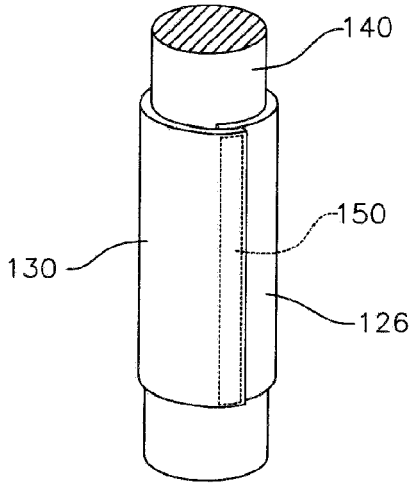

As shown in FIG. 5B, the sheet 130 is then stretched about a cylindrical form 140 (such as a die or a mandrel) of the desired diameter using a vacuum to form at least the side wall 126. In at least one embodiment, the ends 134 of the sheet have a length that is shorter than the sides 132 of the sheet. In some embodiments, vacuum pressure is then used to pull the softened sheet of consumable material into the desired cylindrical shape. In at least one embodiment, after the vacuum pressure has been applied, a second die can be used to finalize the cylinder into the desired cylindrical shape.

Figure 5C:
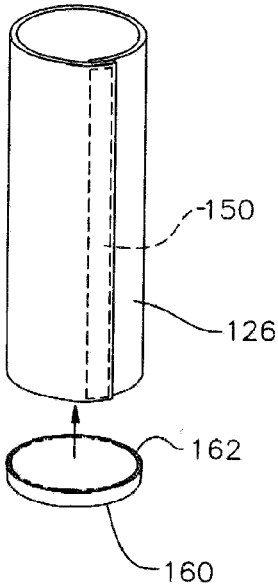

In some embodiments, the sides of the sheet are fastened together in the cylindrical shape with an adhesive 150 forming the side wall 126, as shown in FIG. 5C. In at least one embodiment, the adhesive is cyanoacrylate, but other suitable adhesives may be used. In another embodiment, the sides are welded together using sonic welding, solvent welding, or other appropriate welding processes.

Figure 5D:
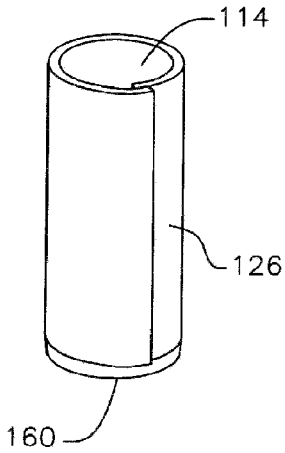

A first circular disc 160 of the consumable material having a desired diameter is then adhered at one end 134 of the cylinder to form either the top wall 122 or the bottom wall 124, as shown in FIG. 5D. The circular disc 160 can either have a diameter that is equivalent to the inner diameter of the cylindrical side wall 126 or the outer diameter of the cylindrical side wall 126. Where the diameter of the circular disc is equivalent to the inner diameter of the side wall, the circular disc 160 is inserted into a lumen 162 formed by the side wall 126 such that an outer surface of the circular disc is flush with the end of the side wall 126. Where the diameter of the circular disc 160 is equivalent to the outer diameter of the side wall 126, the inner surface of the circular disc is engaged with the end of the side wall 126 and adhered thereto. The circular disc 160 is adhered to the side wall 126 using an adhesive 150 such as cyanoacrylate and other suitable adhesives. In another embodiment, the circular disc 160 is welded to the side wall 126 using sonic welding, solvent welding, or other appropriate welding processes.

Figure 5E:
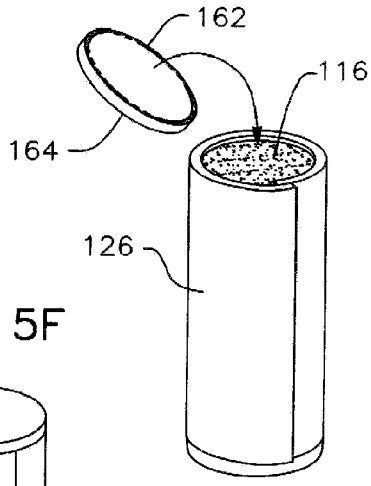

As shown in FIG. 5E, the chamber 114 partially formed by the side wall 126 and the first circular disc 160 is then filled with the desired charge weight of propellant 116. In at least one embodiment, plate loader technology and other standard techniques in the industry can be used to fill the chambers of multiple cylinders simultaneously with a volumetrically measured propellant charge.

Figure 5F:
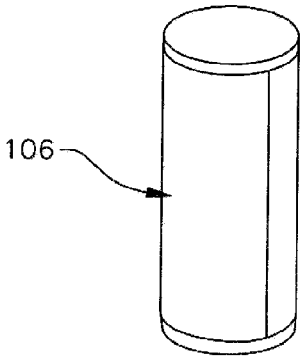

As shown in FIG. 5F, a second circular disc 164 of the consumable material is adhered at the opposite end of the side wall 126 from the first circular disc 160 to seal the propellant 116 in chamber 114. Again, the second circular disc 164 can either have a diameter that is equivalent to the inner diameter of the side wall 126 or the outer diameter of the side wall 126. Where the diameter of the second circular disc 164 is equivalent to the inner diameter of the side wall, the second circular disc is inserted into the lumen of the side wall such that an outer surface of the circular disc is flush with the end of the side wall 126. Where the diameter of the circular disc is equivalent to the outer diameter of the side wall 126, the inner surface of the circular disc is engaged with the end of the side wall 126 and adhered thereto. The circular disc is adhered to the side wall 126 using an adhesive 150 such as cyanoacrylate and other suitable adhesives. In another embodiment, the circular disc is welded to the side wall using sonic welding, solvent welding, or other appropriate welding processes.

In some embodiments, the solid circular discs 160, 164 can be replaced by caps that have a cavity that fits over the ends of the side wall 126. In at least one embodiment, the caps have an outer diameter that is greater than the diameter of the side wall 126. These caps are adhered to the side wall 126 using an adhesive such as cyanoacrylate and other suitable adhesives. In another embodiment, the caps are welded to the side wall using sonic welding, solvent welding, or other appropriate welding processes.

In another embodiment, the encapsulated propellant charge 106 is formed by vacuum thermoforming two portions of a cylinder each with one end enclosed by the mold design. After filling at least a portion of one of the cylindrical portions with the propellant, the two portions are adhered to one another with an adhesive such as cyanoacrylate or could be welded to together sonic welding, solvent welding, or other appropriate welding processes.

In some embodiments, a cylindrical tube of the consumable material can be extruded in relatively long tubes using a thermoplastic extrusion process, examples of which include a screw extruder or batch press with an associated annular extrusion die. The extruded cylindrical tube can then be cut to an appropriate length and closed on both ends using small end caps produced with a stamping operation. The small end caps are attached to the ends of the extruded cylinder using a mechanical fit, an adhesive, sonic welding, solvent welding, and other appropriate attachment processes In some embodiments, a first end cap can be attached to a first end of a cylindrical tube, the chamber can then be filled, and then a second small end cap would then be attached to a second end of the cylindrical tube to finished the sealed propellant charge. In at least one embodiment, as discussed above, a plate loader and/or other standard techniques in the industry can be used to fill the chambers of multiple cylinders simultaneously with a volumetrically measured amount of propellant. In one embodiment, the plate loader can also be used to fit the second small end cap on the second end of cylindrical tube. The second small end cap can then be adhered to the second end of the cylindrical tube to seal the propellant charge at a final sealing station with the adhesive or welding process.

In some embodiments, a sheet of the consumable material can be heated and wrapped around a mandrel to form a relatively long cylindrical tube, which can be cut to an appropriate length and closed on both ends using the small end caps discussed above. In at least one embodiment, multiple sheets of the consumable material can be wrapped around the mandrel in a spiral wrap to create a multi-layered cylinder that can be closed with the end caps discussed above.

In some embodiments, the encapsulated propellant charge 106 can be manufactured by injection molding at least a portion of the capsule into the desired shape.

In at least one embodiment, such as those embodiments shown in FIGS. 3 & 4, at least one cap 129 can be attached to a first end of a molded cylindrical tube having a closed second end, after the chamber has been filled with the desired amount of propellant. In at least the embodiment shown, the second closed end has an arcuate shape. In some embodiments, the cap 129 can be adhered to the cylindrical tube with an adhesive such as cyanoacrylate or welded to together sonic welding, solvent welding, or other appropriate welding processes.

In embodiments where the consumable material used in the propellant charge is a foamed celluloid, the aforementioned methods of manufacture assume that the foaming operation has been completed before shaping, and thus the sheets used to manufacture the encapsulated propellant charge comprise a foamed celluloid. In at least one embodiment, the sheets can comprise an unfoamed celluloid material with a foaming agent in the material and the foaming reaction can take place during the thermoforming or other shaping process where heat and pressure are applied. In an exemplary embodiment, the unfoamed celluloid material can be extruded into the long cylindrical tube and the foaming process would take place within the annular extrusion die under heat and pressure. The annular extrusion die would provide the necessary confinement of the material to control wall thickness, pore size, and density of the foamed celluloid material. In other embodiments, the unfoamed celluloid material is injected into a two part mold with cavities in the desired shape of the encapsulated propellant charge with the vacuum capability to expand the foam once it was pressed into the mold cavities.

Ballistic performance tests were conducted using standard market rifles equipped with pressure transducers and fired in a location equipped to measure muzzle velocity. The ballistic performance of the encapsulated propellant charge as described herein and a non-encapsulated charge is given in table 1 below:

TABLE 1

| Projectile | Propellant | Average Breech Pressure, N/mm$^2$ | Average Velocity, m/s |
|---|---|---|---|
| Sabot, 260 grain | Black powder substitute, 54.6 grain wt., with capsule | 51.39 | 456.6 |
| Sabot, 260 grain | Black powder substitute, 66.2 grain wt., with capsule | 87.65 | 524.3 |
| Sabot, 260 grain | Black powder substitute, 54 grain wt., no capsule | 104.5 | 486.2 |
| Sabot, 260 grain | Black powder substitute, 66 grain wt., no capsule | 115.8 | 530.0 |

As shown in the data presented above, the addition of the capsule had little effect on the average velocity of the projectile as compared to similar propellant charges that were not encapsulated.

Although the above disclosure describes the use of the encapsulated propellant charges in muzzle-loaded firearms, it is within the scope of the invention that appropriately sized encapsulated propellant charges as described herein may also be applicable to other ammunition such as tank rounds and caseless ammunition.

The above disclosure is intended to be illustrative and not exhaustive. This description will suggest many variations and alternatives to one of ordinary skill in this art. The various elements shown in the individual figures and described above may be combined or modified for combination as desired. Those skilled in the art may recognize other equivalents to the embodiments described herein, the equivalents of which are intended to be encompassed by the claims attached hereto. All these alternatives and variations are intended to be included within the scope of the claims where the term "comprising" means "including, but not limited to."

The invention claimed is:

1. A propellant charge comprising a sealed combustible container comprised of a foamed celluloid consumable material and having a generally cylindrical shape, the sealed combustible container comprising a top wall, a bottom wall, and a side wall therebetween; the top wall, the bottom wall and the side wall defining a chamber; wherein the chamber contains a measured amount of propellant composition, wherein the propellant composition is a different material than the consumable material.

2. The propellant charge of claim 1, wherein the side wall has a thickness of less than 0.05 inches.

3. The propellant charge of claim 1, wherein the propellant composition is selected from the group consisting of: smokeless propellant, single base nitrocellulose, nitrocellulose propellant, black powder propellant, pyrotechnic propellant, non-pyrotechnic propellant, and any combination thereof.

4. The propellant charge of claim 1, wherein the sealed combustible container has a length that is greater than its diameter.

5. The propellant charge of claim 4, wherein the ratio of the length of the sealed combustible container to the diameter of the sealed combustible container is at least 2:1.

6. The propellant charge of claim 4, wherein the ratio of the length of the sealed combustible container to the diameter of the sealed combustible container is at least 3:1.

7. The propellant charge of claim 1, wherein the consumable material is water resistant.

8. A muzzle-loader ammunition round comprising:

a bullet held in place with a sabot; and at least one propellant charge engaged with the sabot, the at least one propellant charge having an outer wall constructed from a foamed celluloid consumable material, the outer wall defining a chamber that is at least partially filled with at least one propellant composition having a charge weight, wherein the propellant composition is a different material than the consumable material.

9. The propellant charge of claim 8, wherein the outer wall is water resistant.

10. The propellant charge of claim 8, wherein the propellant composition is selected from the group consisting of smokeless propellant, single base nitrocellulose, nitrocellulose propellant, black powder propellant, pyrotechnic propellant, non-pyrotechnic propellant, and any combination thereof.

11. A method of manufacturing a propellant charge comprising:

forming a cylinder of a desired diameter from a sheet of foamed celluloid consumable material, the sheet having sides and ends, wherein the sides of the sheet are adhered to each other and the cylinder has an open end;

at least partially filling a chamber defined by the cylinder with a propellant composition;

sealing the open end of the cylinder by adhering a circular disc to the open end.

12. The method of claim 11, wherein the propellant composition is selected from the group consisting of: smokeless propellant, single base nitrocellulose, nitrocellulose propellant, black powder propellant, pyrotechnic propellant, non-pyrotechnic propellant, and any combination thereof.

* * * * *